US008689866B2

(12) United States Patent
Patterson et al.

(10) Patent No.: US 8,689,866 B2
(45) Date of Patent: Apr. 8, 2014

(54) AUTOMATED SYSTEMS AND METHODS FOR MAKE-UP AND BREAK-OUT OF TUBULARS

(75) Inventors: John B. Patterson, Cypress, TX (US); Roman K. Nowak, Cypress, TX (US); Justin M. Jarski, Houston, TX (US); Stanislaw C. Sulima, Spring, TX (US)

(73) Assignee: Canrig Drilling Technology Ltd., Houston, TX (US)

( * ) Notice: Subject to any disclaimer, the term of this patent is extended or adjusted under 35 U.S.C. 154(b) by 406 days.

(21) Appl. No.: 13/096,501

(22) Filed: Apr. 28, 2011

(65) Prior Publication Data

US 2012/0273230 A1 Nov. 1, 2012

(51) Int. Cl.
*E21B 19/16* (2006.01)

(52) U.S. Cl.
USPC ..... 166/250.01; 166/380; 166/77.51

(58) Field of Classification Search
USPC ..... 166/250.01, 380, 77.51; 175/24
See application file for complete search history.

(56) References Cited

U.S. PATENT DOCUMENTS

| | | | | |
|---|---|---|---|---|
| 4,402,052 | A | 8/1983 | Stone et al. | |
| 6,536,520 | B1 | 3/2003 | Snider et al. | |
| 7,100,698 | B2 * | 9/2006 | Kracik et al. | 166/380 |
| 7,264,050 | B2 | 9/2007 | Koithan et al. | |
| 7,281,587 | B2 | 10/2007 | Haugen | |
| 7,296,623 | B2 | 11/2007 | Koithan et al. | |
| 7,568,522 | B2 | 8/2009 | Boutwell et al. | |
| 7,594,540 | B2 | 9/2009 | Koithan et al. | |
| 7,712,523 | B2 | 5/2010 | Snider et al. | |
| 7,896,084 | B2 | 3/2011 | Haugen | |
| 8,281,856 | B2 * | 10/2012 | Jahn et al. | 166/250.01 |
| 2004/0144547 | A1 * | 7/2004 | Koithan et al. | 166/380 |
| 2004/0154832 | A1 * | 8/2004 | Koithan | 175/26 |
| 2005/0077084 | A1 * | 4/2005 | Kracik et al. | 175/24 |
| 2005/0269104 | A1 | 12/2005 | Folk et al. | |
| 2008/0047749 | A1 * | 2/2008 | Koithan et al. | 175/40 |
| 2008/0125876 | A1 | 5/2008 | Boutwell | |
| 2010/0138159 | A1 * | 6/2010 | Conquergood et al. | 702/9 |

OTHER PUBLICATIONS

International Search Report and Written Opinion received in corresponding Patent Cooperation Treaty Application No. PCT/US2012/035172, dated Nov. 29, 2012, 14 pages.

* cited by examiner

*Primary Examiner* — William P Neuder
(74) *Attorney, Agent, or Firm* — Haynes and Boone, LLP

(57) ABSTRACT

An automated tubular handling system adapted to make-up or break-out tubulars that includes a rotary drive adapted to operatively grip a tubular to be connected to or disconnected from a tubular string, a controller adapted to receive and process data indicative of a rotation, torque, and minimum time value associated with a make-up or a break-out of the tubular string, and a user interface adapted to convey the received data, the predetermined values, or both, of the tubular make-up or break-out to an operator. The controller compares the rotation, torque, and minimum time values to acceptable predetermined values to determine when the make-up or the break-out is complete. Automated methods are also disclosed.

27 Claims, 2 Drawing Sheets

AUTOMATED SYSTEMS AND METHODS FOR MAKE-UP AND BREAK-OUT OF TUBULARS

FIELD OF THE INVENTION

The invention relates to automated tubular handling systems adapted to make-up or break-out tubulars to or from a tubular string with a rotary drive, a controller adapted to receive and process associated data indicative of a rotation, torque, and a minimum time value by comparing the rotation, torque, and minimum time values to acceptable predetermined values to determine when the make-up or the break-out is complete, and a user interface, along with methods and apparatus for achieving such tubular make-up or break-out.

BACKGROUND

Oil and gas well drilling systems include numerous types of piping, referred to generally as "tubulars." Tubulars include drill pipes, casings, and other threadably connectable oil and gas well structures. Long strings of joined tubulars are typically used to drill a wellbore or to inhibit or prevent collapse of the wellbore after drilling. Some tubulars are fabricated with male threads on one end and female threads on the other. Other tubulars feature a male thread on either end and connections are made between tubulars using a threaded collar with two female threads. The operation of connecting a series of tubulars together to create a string is known as a "make-up" process, while the reverse is often referred to as a "break-out" process.

When joining lengths of tubulars for oil wells, the nature of the connection between the lengths of tubing is critical. In particular, as the petroleum industry has drilled deeper into the earth during exploration and production, increasing pressures have been encountered. Reliable methods are needed to ensure a good connection.

One connection method involves the connection of two co-operating threaded pipe sections, rotating the pipe sections relative to one another by means of a power tong, measuring the torque applied to rotate one section relative to the other and the number of rotations or turns which one section makes relative to the other. Signals indicative of the torque and turns are fed to a controller that ascertains whether the measured torque and turns fall within a predetermined range of torque and turns that are known to produce a good connection. Upon reaching a torque-turn value within a prescribed minimum and maximum (referred to as a dump value), the torque applied by the power tong is terminated. An output signal, e.g., an audible signal, is then operated to indicate whether the connection is a good or a bad connection.

Current practice often involves make-up of the connection to within a predetermined torque range while plotting the applied torque vs. rotation or time, and then making a visual inspection and determination of the quality of the make-up. This requires a third party interface with a manual human response to stop the make-up process. In many implementations, manual intervention is needed to check for contact between tubulars before rotation for make-up. Some conventional attempts at automation of the make-up process rely on information that is too limited to monitor and confirm that a proper connection has been made. Various conventional make-up techniques are described in U.S. Pat. Nos. 7,712,523; 7,594,540; 7,568,522; 7,296,623; 7,281,587; 7,264,050; 7,100,698; 6,536,520; and 7,896,084.

Accordingly, a need exists for an automated make-up system and methods that ensure a good connection is made while minimizing or eliminating direct human involvement.

SUMMARY OF THE INVENTION

The invention encompasses an automated tubular handling system adapted to make-up or break-out tubulars to or from a tubular string that includes: a rotary drive adapted to operatively grip and rotate a tubular, a controller adapted to receive and process data indicative of a rotation, torque, and a minimum time value associated with a make-up or a break-out of the tubular and the tubular string, wherein the controller compares the rotation, torque, and minimum time values to acceptable predetermined values to determine when the make-up or the break-out is complete, and a user interface adapted to convey the received data, the predetermined values, or both, of the tubular make-up or break-out to an operator.

In a preferred embodiment, the system further includes a server that includes comparative handling information for a plurality of tubulars and that is adapted to exchange information between each of the controller and the user interface, wherein the handling information includes at least one of thread count and sizing, or rotation information required to make-up or break-out a pair of tubulars. In a more preferred embodiment, the system including a plurality of sensors operatively associated with the rotary drive to measure rotation, torque, and minimum time in operation. In another more preferred embodiment, the system further includes a communications network adapted to communicate received data from one or more sensors to the controller, between the controller and the server, and from the controller or server to the user interface, or any combination thereof. In another preferred embodiment, the communications network is wireless.

In another embodiment, the system further includes an operational stop button adapted to permit a human operator to interrupt the controller and cease automated tubular handling without dropping the tubular. In yet another embodiment, the user interface includes a display unit. In yet another embodiment, the controller is adapted to stop the make-up or break-out process when the minimum time value is exceeded and at least one of the rotation and torque values at least substantially match the corresponding predetermined values. In yet another embodiment, the system further includes a counterbalance operatively associated with the rotary drive to provide feedback on at least one of the position of, or weight applied by, a tubular or a tubular string, or both. In yet a further embodiment, one or more of the acceptable predetermined rotation, torque, and minimum time elapsed values depend on one or more parameters associated with the tubulars being handled. In a preferred embodiment, the parameters are adjusted based on a plurality of factors including the grade of pipe, type of tubular, nominal outer diameter size, weight per foot, number of threads, collar thread type, or a combination thereof.

The invention also encompasses automated methods of making-up or breaking-out tubulars with or from a tubular string, by selecting a first tubular and a second tubular to make-up or break-out from each other, wherein the second tubular forms a part of the tubular string, inputting information about the tubulars to a controller, initiating rotation to make-up or break-out the first tubular with or from the second tubular, monitoring one or more sensors during the make-up or break-out to obtain measured data regarding rotational turns, torque, and minimum time elapsed from initiating rotation, comparing the measured data to acceptable predetermined values of rotational turns, torque, and minimum time elapsed, and stopping rotation based on the comparison of the minimum time elapsed from initiating rotation, and either rotational turns or torque, wherein at least two of the measured data meet or exceed at least two of the corresponding acceptable rotational turn, torque, and minimum time elapsed values.

In one embodiment, the inputted information about the tubulars is adjusted based on a plurality of factors including the grade of pipe, type of tubular, nominal outer diameter size, weight per foot, number of threads, collar thread type, or a combination thereof. In another embodiment, the method further includes initiating remedial action if one of the values for turns, torque, or minimum time elapsed is unacceptable. In a preferred embodiment, the remedial action includes automatic reinitiation of make-up or break-out, or a combination thereof. In yet another preferred embodiment, the remedial action includes providing a warning signal to an operator. In one more preferred embodiment, the operator manually stops or reinitiates the rotation, or both.

In another embodiment, the method further includes measuring the change in torque between the first and second tubulars, change in tension value of each counterbalance cylinder, or a combination thereof. In yet another embodiment, the torque is measured based on a rotary drive connected to a tubular being made-up or broken-out. In a preferred embodiment, at least one counterbalance cylinder is present and has feedback that includes at least one of a position of a tubular relative to an initial position, relative to the tubular string, relative to rotary drive, or a combination thereof; minimum time of rotation; and force settings of weight applied on a tubular or a tubular string, or both. In another embodiment, the acceptable predetermined values of rotational turns, torque, and time include at least two of maximum, minimum, and optimum values. In yet another embodiment, the communicating includes wireless communication between the controller and a plurality of sensors operatively associated at the controller, a server, or both, for measuring rotation, torque, and minimum time elapsed. In yet another embodiment, the method further includes displaying the measurement data to an operator. In one preferred embodiment, the display shows the words PASS and a second indicia of success when the measurement data is sufficiently acceptable or FAIL and a second indicia of failure when the measurement data is unacceptable. In yet another embodiment, the method further includes comparing at least two of the measured data values to at least two of the acceptable predetermined values, wherein at least one of the values is minimum time elapsed. In a further embodiment, the controller, operator, or both initiate termination of the rotation. In a preferred embodiment, the controller slows rotation based on one or more of the compared values before stopping rotation.

The invention also encompasses an automated method of making up or breaking out tubulars with or from a tubular string with a rotary drive, by selecting a first tubular and a second tubular to make-up or break-out, inputting information about the tubulars into a controller, wherein the controller is programmed with predetermined acceptable values of turns, torque, and minimum time elapsed, initiating rotation to make-up or break-out of the tubular with or from the tubular string, monitoring rotational turns, torque, and minimum time elapsed during the make-up or break-out to obtain measured data, communicating the measured data from sensors operatively associated with the rotary drive to the controller, and stopping rotation based on a comparison of the measured data being within the range for all three of the acceptable rotational turns, torque, and minimum time elapsed from initiating rotation values. In one embodiment, the method further includes initiating remedial action if one of the values for turns, torque, or minimum time elapsed is unacceptable. In yet another embodiment, the method further includes displaying the measured data to an operator.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION OF PREFERRED EMBODIMENTS

The present invention relates to the synergistic combination of information from multiple parameters coupled with a control module/controller that modifies rotary drive operations based on feedback to yield increased confidence regarding automated tubular make-up and break-out operations. The inventive systems and methods seek to minimize both human error and run time, while advantageously providing increased speed and economic feasibility of running tubulars. This can be achieved with the automated and more failsafe nature of the data used according to an embodiment of the invention to confirm proper make-up or break-out of tubulars.

The present systems and methods have application to any variety of threaded members having a shoulder seal including but not limited to: tubulars, e.g., drill pipes, tubings, and casings; risers; and tension members. The likelihood of loose connections and damage to threaded joints is mitigated according to aspects of the present invention.

Figure 1:
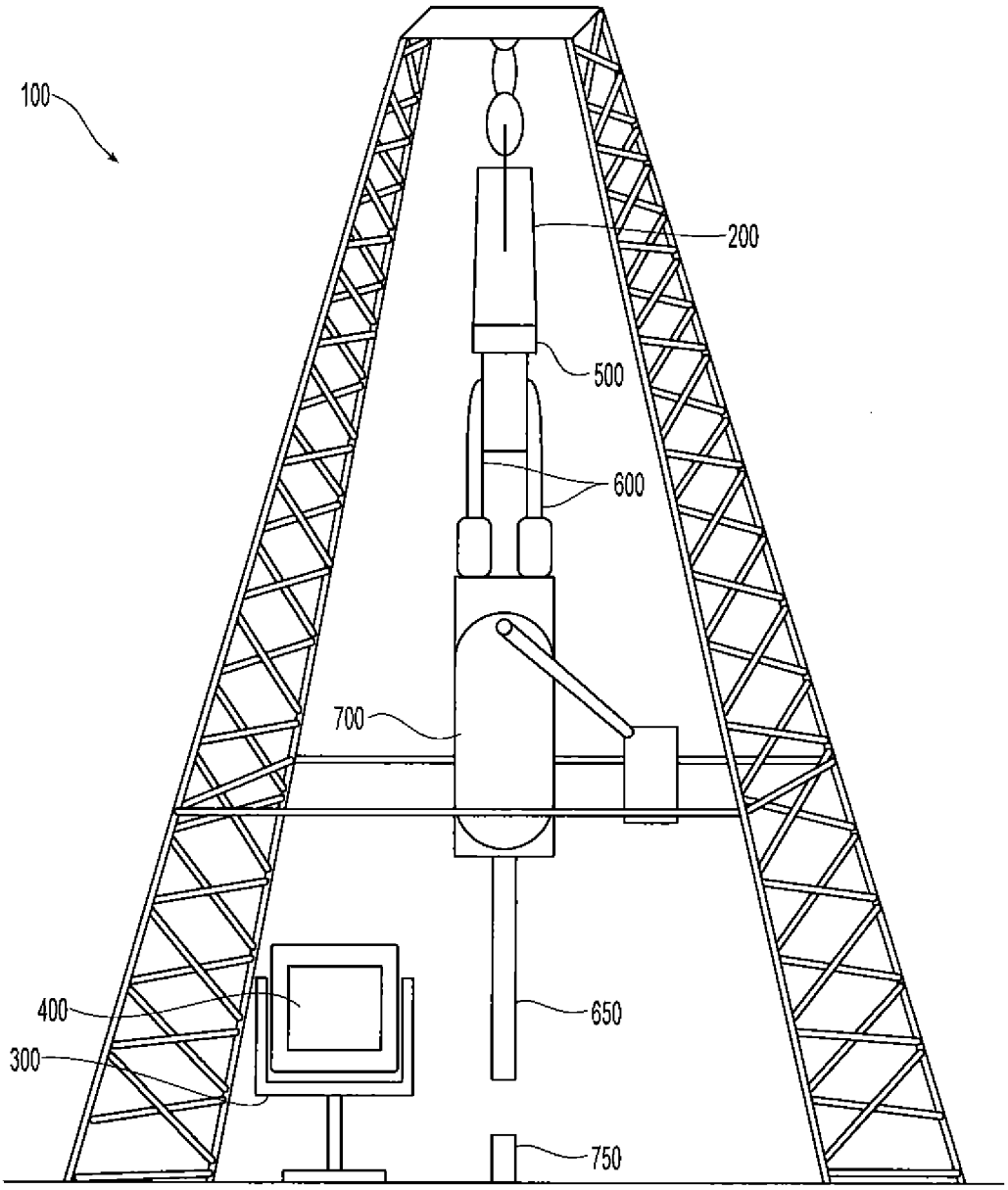
FIG. 1 is an illustration of a preferred embodiment of an automated make-up system according to one or more aspects of the present disclosure.

Referring to FIG. 1, the automated tubular handling system 100 of the present invention is adapted to make-up or break-out tubulars. The system includes a rotary drive 200 adapted to operatively grip a tubular, a controller 300, a user interface 400, and a tubular handling device 700. The rotary drive 200 typically includes a top drive or a kelly drive. The tubular handling device 700 includes any suitable drilling or tubular gripping mechanism. Preferably, the tubular handling device 700 is a device that includes one or more features described in U.S. Pat. Nos. 7,445,050 and 7,552,764; U.S. Publication No. 2009/0321064; and U.S. application Ser. No. 12/982,644 filed Dec. 30, 2010, the entire contents of each which is hereby incorporated herein by express reference thereto. Optionally, but preferably, the system also includes a server (not shown) operatively associated with at least the controller and optionally also the user interface. Such a server can include comparative handling information for a plurality of tubulars and be adapted to exchange information between each of the controller and the user interface.

The controller 300 includes a programmable central processing unit that is operable with a memory, a mass storage device, an input control unit, and a display unit. Additionally, the controller 300 can include one or more support circuits, such as power supplies, clocks, cache, input/output circuits, and the like. The controller 300 is adapted to receive data from sensors 500 or other devices, or a combination thereof, and is adapted to control one or more devices connected to it. The controller 300 can be any programmable device, e.g., any suitable Programmable Logic Controller (PLC) such as a computer.

During normal operation, the controller 300 executes the main program reading, comparing and calculating torque, turns, and minimum time elapsed values on a repetitive basis. Preferably, the turns, torque, and minimum time elapsed values are measured at regular intervals. In one embodiment, a computer retrieves the programming instructions and stores them in the main memory or other more permanent electronic storage, e.g., flash memory, hard drive, or any other available storage. The computer then executes the programming instructions stored in the main memory (or other storage) to implement the functions of the make-up control system. Many embodiments herein reference only the "make-up" of tubulars, however, the invention should be understood to include the opposite of all such make-up apparatus, system, and methods for break-out purposes, as well. The computer uses the programming instructions to generate the command signals and transmit the command signals to the rotary drive 200. The rotary drive 200 responds to the command signals and generates the feedback signals that are transmitted back to the controller 300. The computer receives the feedback signals via an external I/O device. The computer then uses the feedback signals and the programming instructions to generate additional command signals for transmission to the rotary drive 200.

Importantly, the controller 300 of FIG. 1 is responsive to the signals corresponding to: 1) torque applied by the rotary drive to the tubular 650 and/or between the tubular 650 and the tubular string 750; 2) the minimum time elapsed between individual phases of a make-up or break-out operation, or the time elapsed since the start of an operation to the end; and 3) rotational turns of the tubular 650. These parameters are used for determining when a good or bad joint has been made, or when a joint has been disconnected properly. For example, if a cross-threading has occurred at the start of a make-up operation, the torque will increase too rapidly before even the minimum time has elapsed and the operation will be considered a bad connection. When bad connection has occurred, the rotatable tubular is preferably backed off by reversing in the opposite direction to ensure the operation is starting with the threads at the proper separated but adjacent or contacting position.

The controller 300 monitors the turns count signals, torque signals, and minimum time signals, and compares the measured values of these signals with predetermined values. The comparison of measured turn count values, torque values, and time values with respect to predetermined values is performed by one or more functional units of the computer, such as a controller module or other suitable functional unit.

Preferably, the controller 300 stops the make-up or break-out process when at least two of the three rotation, torque, and minimum time elapsed values at least substantially match the same parameter of predetermined values. In an exemplary embodiment, the controller 300 stops the process based on all three parameters. In one embodiment, at least one of the parameters is minimum time elapsed since the start of an operation to make-up or break-out tubulars or a tubular string. By "substantially match" is meant that the value falls within about 1 to 20 percent of the predetermined value, preferably about 3 to 15 percent, and more preferably about 5 to 10 percent. In a preferred embodiment, the predetermined value is itself a range of values. For example, if the predetermined value for torque is 3750 ft-lbs to 7500 ft-lbs, for the measured torque to substantially match, the measured torque would be about 3000 ft-lbs to 9000 ft-lbs, preferably about 3187.5 ft-lbs to 8625 ft-lbs, and more preferably about 3375 ft-lbs to 8250 ft-lbs.

Illustrative predetermined values that may be input or selected from computer memory (or other storage) for a particular connection, by an operator or otherwise, include a delta torque value between a tubular being made-up or broken-out and the tubular string, a delta turn value (i.e., change in the number of turns), a delta tension value (e.g., change in tension of one or more counterbalance cylinders), minimum and maximum turn values, minimum and maximum torque values, minimum and maximum elapsed time values, optimum torque values, optimum turn values, and optimum time elapsed values. Preferably, the acceptable predetermined values of rotational turns, torque, and minimum time elapsed are selected and include at least two of maximum, minimum, and optimum values. The predetermined values may be input by an operator to the computer via an input device, such as a keypad, which can be included as one of a plurality of input devices. The controller 300 was developed to automate the process with simple, easy to use interfaces.

The predetermined values are based on certain parameters of the tubular 650, including, for example, grade of pipe, type of tubular, nominal outer diameter size, weight per foot, collar thread type, number of threads, number of threads per inch, or a combination thereof. In addition to geometry of the threaded members, various other variables and factors may be considered in deriving the predetermined values of torque, turns, and minimum elapsed time. For example, the lubricant and environmental conditions may influence the predetermined values. In one embodiment, a set of predetermined parameters (theoretical, derived from statistical analysis of previous batches, or derived from measured values) is stored in the controller 300 for a particular tubular connection using the information derived from previous make-up or break-out operations. In other embodiments, the values stored in the database are collected from different wellbores or multiple wellbores. This information may then be retrieved quickly during identical conditions. In some embodiments, the predetermined values are continuously updated based on the feedback signals communicated to the controller 300 during the current operation.

When either a minimum torque, a minimum time value, or a minimum turns value has been reached, the controller 300 will look for the minimum value of the other parameters and indicate that a good joint has been made if the minimum value of the other parameters is reached before the maximum value for one of the parameters is reached. In the event two parameters are used for a given make-up, rotation may continue upon reaching the first target or until reaching the second target, so long as both values stay within an acceptable range.

The controller 300 or operator can initiate termination of rotation during make-up or break-out if the feedback signals indicate that a bad connection has been made. For example, if one of the values for turns, torque, or time is unacceptable, the controller 300 may generate dump signals to shut down the rotary drive 200 to allow the tubular 650 to stop. Dump signals may also be issued upon detecting the terminal connection position or a bad connection. These signals may automatically shut down the operation, or may be used to signal an operator for repair, or both. The system may further generate warning signals to the operator, such as an audio signal, flashing lights, etc. For example, if after the minimum time elapsed the maximum time then elapses without achieving the proper values for turns and torque, the connection (or disconnection) will be considered a failure by the controller and remedial action will be taken. Another example is when the values for turns or torque exceed the maximum permitted before the minimum time elapse from start of the operation, in which case the connection (or disconnection) will also be considered a failure.

Preferably, the system 100 includes operational stop buttons adapted to permit a human operator to manually cease automated tubular handling. Operational stop buttons on the rig floor and at the driller's control station are preferred.

In the depicted embodiment, the controller 300 confirms proper make-up or break-out, and if any of the three parameters fails then reinitiation or breaking out may be required at the operator's discretion. The controller 300 initiates remedial action upon one of the measured values being unacceptable. The remedial action usually include reinitiation of make-up or break-out out of the connection, or a combination thereof.

Typically, to reinitiate a make-up operation, the controller 300 breaks out the connection and automatically starts the connection process again. In one embodiment, after the first failure, the controller 300 may automatically signal the operator to re-input the parameters of the tubular, check that the current parameters are correct, or to select a new tubular. In other embodiments, the controller 300 will attempt to make-up the connection again and if a proper connection is still not made after multiple attempts, the controller 300 asks the human operator to check and input new data.

As depicted, the system 100 uses sensors 500 to measure the number of drive shaft turns, the current top drive torque, and the time of rotation. This information is used by the controller 300 to confirm that the tubular pair has actually joined and that the make-up or break-out sequence is complete. It should be understood that in one embodiment, the system 100 may directly measure one or more of turns, torque, and minimum time of rotation based on sensor input, which is often provided through the control.

In another embodiment, turn counters, such as optical sensors, can be placed at the rotary drive 200 to sense the rotation of the tubular 650 and generate turn count signals representing such rotational movement. Similarly, torque transducers can be attached to the rotary drive 200 to generate torque signals representing the torque applied. The torque sensor may also be implemented as a current measurement device for an electric rotary table or top drive motor, or as a pressure sensor for a hydraulically operated top drive. Sensors for measuring time may also be placed at the rotary drive 200 to directly measure the time from start to finish of a make-up or break-out operation, or to measure time between the phases of the operation. In one embodiment, time elapsed is calculated based on the speed of rotation coupled with the number of turns.

Alternatively or additionally as a backup, the controller 300 may calculate torque and rotation output of the rotary drive 200 by measuring voltage, current, and/or frequency (if AC top drive) of the power input to the rotary drive 200. For example, in a DC top drive, the speed is proportional to the voltage input and the torque is proportional to the current input. An AC top drive will require additional calculations based on various factors known to those of ordinary skill in the art through routine experimentation.

The sensor measurement data is communicated to the controller 300, preferably by wireless communications network, such as radio, ethernet, or cellular, that is programmed with instructions for various types of tubulars to determine when the make-up or break-out sequence is complete. In particular, optimum values and ranges for the parameters with a minimum and maximum (or both) are available to the controller 300. In one embodiment, the time elapsed parameter is only measured based on the minimum to ensure make-up takes at least a certain length of time. A minimum time elapsed might be about 0.5 to 10 seconds, preferably about 0.8 to 6 seconds from start of an operation, to ensure the handling operation proceeds properly, at which point the minimum and maximum torque values, turn values, or both, become relatively more important to ensure a proper connection or disconnection. Preferably, however, the torque, rotational, and minimum time values are measured, preferably directly.

During make-up of a tubular assembly, various outputs may be observed by an operator on an output device, such as a user interface 400, e.g., a display screen, which may be one of a plurality of output devices. The display can include one or more of, e.g., a five digit display of the actual torque, turns, and time in real time; status lights indicating good and bad joints or joint connections; reference values for torque, turns, and minimum time; and a warning to the operator to be ready to stop rotation. The display preferably shows the measurement data to the operator, and shows the words PASS and preferably at least one different indicia of success when the measurement data is sufficiently acceptable, or FAIL and preferably at least one different indicia of failure when the measurement data is unacceptable, to allow the controller or the operator to make decisions about further steps in the drilling, casing, or other overall process of which the make-up or break-out forms a part. This pass/fail test confirms that the tubular pair has actually joined, and the controller 300 can reinitiate the make-up process if no connection was created. For example, the PASS signal can be accompanied by a green light, a short note like the ding of a bell, or a voice stating the word PASS, or a combination thereof, while the FAIL signal can be accompanied by a red light, a harsh klaxon tone, a voice stating the word FAIL or FAILURE, or a combination thereof. A good connection, which will depend on all the tubular and connection variables discussed herein, might typically take about 15 to 90 seconds, preferably about 30 to 60 seconds, and involve at least 4 turns at a minimum to about 40 turns at a maximum of the rotatable tubular depending on the particular type of tubular involved, preferably about 6 to 25 turns.

An operator or the controller may review the data on the display to determine if further action is required. If the parameter measured by the sensor 500 is not substantially within the predetermined values, then the operator may cause the controller 300 to modify or adjust well bore equipment such that the parameter will conform to the predetermined values. Alternatively, the respective operator may manually cause the controller 300 to stop operation of the corresponding well bore equipment if he determines it is not possible to control the equipment to keep the parameter within the predetermined values or for safety reasons.

The format and content of the displayed output may vary in different embodiments. By way of example, an operator may observe the various predetermined values that have been input for a particular tubular connection. Further, the operator may observe graphical information such as a representation of the torque rate curve and the torque rate differential curve.

The plurality of output devices may also include a printer such as a strip chart recorder or a digital printer, or a plotter, such as an x-y plotter, to provide a hard copy output, or electronic storage such as memory, flash memory, hard-drive, or other electronic media that permits recording and retrieval of information. The plurality of output devices may further include a horn or other audio equipment to alert the operator of significant events occurring during make-up, such as the shoulder condition, the terminal connection position, or a bad connection. In one preferred embodiment, the display is arranged to show information graphically to an operator, or graphically coupled with information in numerical, tabular, or other firm, as well as either a hard copy, electronic storage, or both. In another preferred embodiment, the output is transmitted wirelessly or through wired connection directly to the internet and made accessible to a user who is remote from the controller. "Remote" as used in this context refers to a user who is in another location on a rig, such as the driller's doghouse, on an adjacent or nearby rig in the same oil or gas field, or off-rig. Preferably, the output transmitted to the internet is synchronized with the output of one or more additional systems on the same rig or other rigs, such as the well prog analysis and well drilling control systems and methods of U.S. Pat. No. 7,860,593, the entire contents of which is hereby incorporated herein by express reference thereto. The output could alternatively or additionally be synchronized over the internet with the output of the systems and methods of remotely monitoring well drilling disclosed in U.S. patent application Ser. No. 11/847,048, filed Aug. 29, 2007, the entire contents of which is hereby incorporated herein by express reference thereto.

As discussed above, the controller 300 can determine through the data received from various sensors 500 that an acceptable threaded joint has been made between the tubular 650 and tubular string 750. Alternatively, or in addition to the foregoing, a counterbalance 600 may be used to gather information about the joint formed between the tubular 650 and the tubular string 750. The counterbalance 600 may function similar to a spring or a hydraulic piston-cylinder arrangement to compensate for vertical movement between the rotary drive 200 and, e.g., the casing-running equipment during threading (or unthreading) of the tubular 650 and the tubular string 750. The counterbalance 600 is operatively associated with the rotary drive 200 to preferably provide feedback on at least one of the position or weight applied by a tubular 650 or a tubular string 750, and in one embodiment includes the weight of both the, e.g., casing-running equipment and the tubular.

The counterbalance 600, in addition to allowing incremental movement of the rotary drive 200 relative to the exemplary casing-running equipment during threading together (or unthreading apart) of the tubulars, may be used to ensure that a threaded joint has been made or broken and that the tubulars are mechanically connected together or separated, respectively. For example, after a joint has been made between the tubular 650 and the tubular string 750, the spring or cylinder of a counterbalance may have been fully extended, or "stroked out," due to the downward movement of the tubular 650 having been fully threaded onto the string. If a joint has not been formed between the tubular 650 and the string 750, however, due to some malfunction of the rotary drive 200 or misalignment between a tubular and a tubular string therebelow, the counterbalance 600 cylinder or spring will not have extended or will have only partially extended due to the relatively little force applied thereto by the single tubular having not moved along (or fully along) the length of threads on the tubular string to complete a connection.

A stretch sensor located adjacent the counterbalance 600 can be used to sense the stretching of the counterbalance 600 and can relay the data to the controller 300, to measure a counterbalance feedback. The counterbalance feedback includes, for example, at least one of the position of a tubular relative to the start position, relative to the tubular string, relative to the rotary drive or relative to an arbitrary but fixed point, or a combination thereof. Feedback can also include the time of rotation and force settings of weight applied on a tubular or a tubular string, or both, or this can come from other sensor sources such as a rotary drive motor, a shaft, or a floor gripping device, or a combination thereof.

Figure 2:
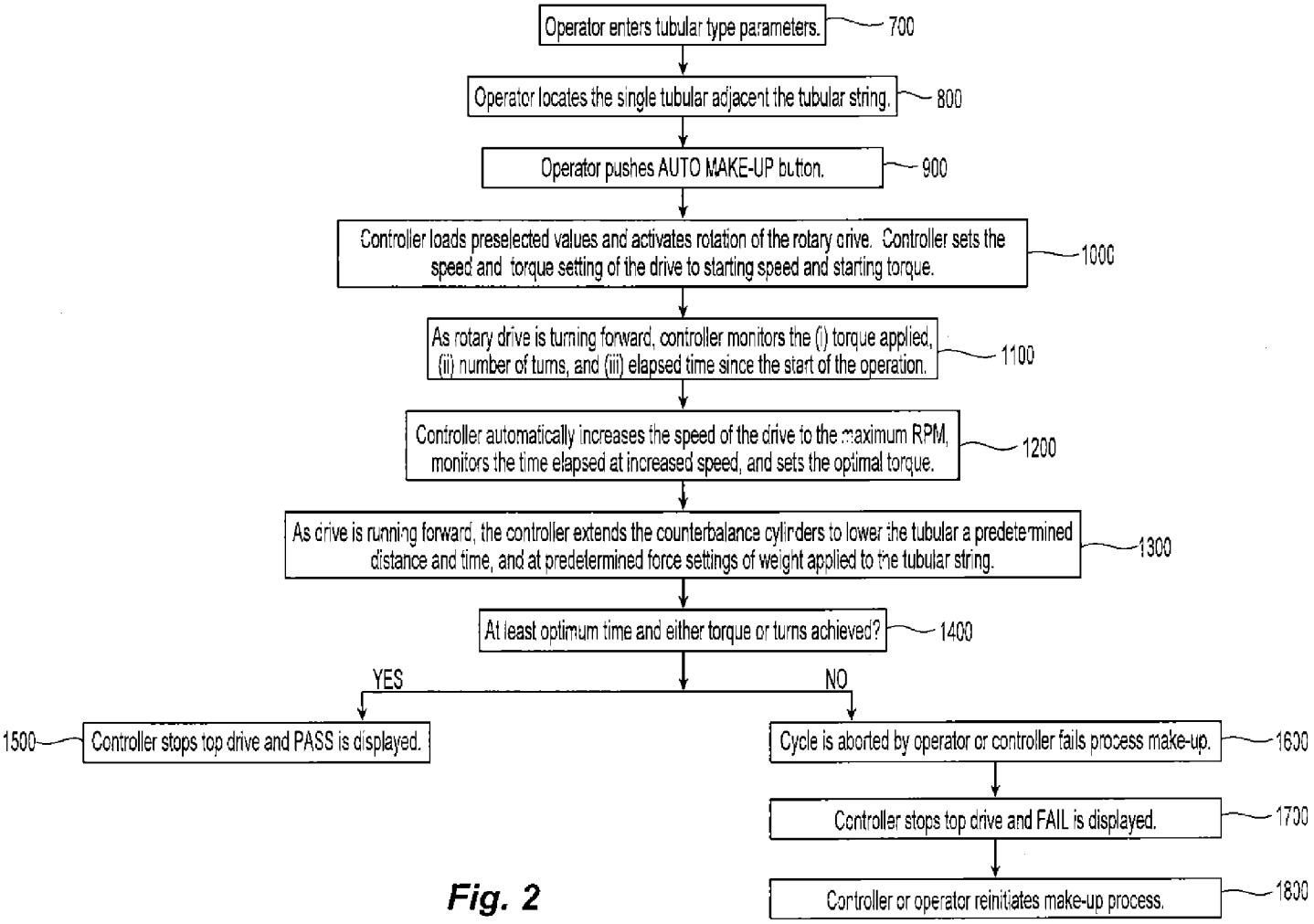
FIG. 2 is a process flow diagram of a preferred make-up process according to one or more aspects of the present disclosure.

A preferred embodiment of an automatic make-up process will now be described in detail with reference to FIG. 2.

In step 700, the operator enters the parameters of the tubular through an input device, such as a keyboard, which can be included in a plurality of input/output devices. The parameters are used to prepare predetermined values of low, minimum, and maximum turns, torque, and time; and reference, minimum, and maximum turns, torque, and time. In another embodiment, a single code can be entered for a type of tubular, and an associated electronic storage will correlate this code with all the other parameters stored in a database to load them into the controller. Alternatively, inputting can be automatically achieved through use of sensors, e.g., by reading a bar code at the end of the tubular, through a radio frequency ID embedded in each tubular, by measuring outer diameter and thread count, or through other measured or measured plus calculated variables.

After the operator has located the single tubular adjacent to or actually in contact with the tubular string and is ready to start a connection make-up in step 800, the operator pushes an AUTO MAKEUP button on the control panel in step 900. In step 1000, the controller loads the predetermined values of torque, turns, and time. The two threaded members (e.g., male and female pipe, casing, or pipe or casing and collar) are brought together with relative rotation induced by a rotary drive unit. The controller matches the threads of the rotatable tubular with the threads of the stationary tubular (typically the tubular string or a collar attached thereto), and transmits command signals to the rotary drive to initiate rotation of the rotatable tubular. The controller starts spinning the tubular at the starting speed and starting torque. The starting speed and torque are preferably less than the full threading (or unthreading) speed and torque to provide an opportunity for the controller to help ensure a proper connection or disconnection have begun. Throughout the threading (or unthreading), the controller monitors the applied torque, the number of turns, and the elapsed time since the start, of the rotatable tubular by monitoring the torque feedback signal, the turn feedback signal, and the time feedback signal, which are all transmitted to the controller, as shown in step 1100. The controller or an operator then speeds up rotation to the maximum RPM once the initial threads are engaged and advancement has started in step 1200. The controller can determine the initial threads are engaged by, for example, a minimum time elapsed from start of the operation, initial extension of a counterbalance, change in vertical position of the rotatable tubular, change in torque (e.g., between the tubulars), number of turns, etc. In a breakout operation (not shown), it will be the initial decrease in torque as the unthreading begins that lets the controller determine the unthreading as successfully begun.

The counterbalance "floats" the tubular and optionally the associated handling equipment (e.g., casing-running tool) as it screws in to inhibit or prevent misthreading. In step 1300, the counterbalance cylinders are lowered a predetermined distance for a predetermined time at predetermined force settings of weight applied to the tubular string, based on the parameters of the tubular. A turn sensor senses the rotation of the tubular and generates a signal representing such rotational movement. Similarly, a torque transducer generates a signal representing the torque applied to the tubular by the rotary drive, and a time sensor sends signals on the start of the process.

In one embodiment, the applied torque, rotation, and time are measured at regular intervals. The frequency with which torque, time, and rotation are measured may be specified by the operator (e.g., every half-second or second, or more or less frequently), and the measured values may be stored in computer memory or other electronic storage. Further, the rate of change of torque with respect to rotation may be calculated for each paired set of measurements by a torque rate differential calculator. These three values (torque, rotation, and time) may be plotted by a plotter for display on an output device.

The signals from the sensors are sent to the controller. The controller itself or an operably associated computer then monitors the counters and transducer signals and compares the present values of these signals with the predetermined values to provide control signals to the controller, either continuously or at selected rotational positions.

Based on the comparison of measured or calculated values with predetermined values, the controller determines the occurrence of various events and whether to continue rotation or abort the make-up (or break-out). If the controller determines the operation is a bad connection, rotation may be terminated and optionally but preferably automatically or manually reinitiated. Otherwise, rotation continues until the desired shoulder up or down condition is detected. If the values are not acceptable, the controller indicates a bad connection.

When at least two of the three parameters have been satisfied in step 1400, e.g., torque and time or turns and minimum elapsed time, the operator will be signaled by the computer through an output device of a passing condition, such as a green light and a steady audio tone. The controller slows down rotation of the tubular based on, for example, the turns count from the top drive and/or counterbalance feedback in advance of actually ceasing the rotation. The reduction in speed allows the rotatable tubular to form a solidly threaded connection with the stationary tubular without damaging the tubulars, particularly the threads thereof. The same reduction in speed may be used just before a break-out is completed, as well. This slow down may occur, in one embodiment, about 0.2 to 2 seconds before the operation is completed.

In step 1500, the controller finally stops spinning the top drive or other rotary drive once the optimum values of at least two of the parameters (within acceptable ranges) is achieved through closed-loop feedback from the rotary drive. The display screen will show PASS if minimum values are achieved.

If the optimum values are not achieved as shown in step 1600, the make-up cycle is aborted, or the controller fails the process. In step 1700, the controller stops the top drive and displays FAIL on the screen. The controller or operator may then reinitiate the process in step 1800.

The computer can signal a bad joint with a red light and a warbling or klaxon-type audio tone. In addition, the computer can generate a dump signal to automatically shut down the rotary drive upon reaching either a good or a bad joint. The computer can also output signals representing the torque and turns values to a printer such as a strip chart recorder or a digital printer, or a plotter, such as an x-y plotter, or electronic storage, or other output as discussed herein.

The term "about," as used herein, should generally be understood to refer to both numbers in a range of numerals. Moreover, all numerical ranges herein should be understood to include each whole integer within the range.

Although preferred embodiments of the invention have been described in the foregoing description, it will be understood that the invention is not limited to the specific embodiments disclosed herein but is capable of numerous modifications by one of ordinary skill in the art. It will be understood that the materials used and the mechanical details may be slightly different or modified from the descriptions herein without departing from the methods and devices disclosed and taught by the present invention.

What is claimed is:

1. An automated tubular handling system adapted to make-up or break-out tubulars to or from a tubular string which comprises:

a rotary drive adapted to operatively grip and rotate a tubular;

a controller adapted to receive and process data indicative of a rotation, torque, and a minimum time value associated with a make-up or a break-out of the tubular and the tubular string, wherein the controller compares the rotation, torque, and minimum time values to acceptable predetermined values to determine when the make-up or the break-out is complete;

a user interface adapted to convey the received data, the predetermined values, or both, of the tubular make-up or break-out to an operator; and a server that includes comparative handling information for a plurality of tubulars and that is adapted to exchange information between each of the controller and the user interface, wherein the handling information comprises at least one of thread count and sizing, or rotation information required to make-up or break-out a pair of tubulars.

2. The system of claim 1, further comprising a plurality of sensors operatively associated with the rotary drive to measure rotation, torque, and minimum time in operation.

3. The system of claim 2, further comprising a communications network adapted to communicate received data from one or more sensors to the controller, between the controller and the server, and from the controller or server to the user interface, or any combination thereof.

4. The system of claim 3, wherein the communications network is wireless.

5. The system of claim 1, further comprising an operational stop button adapted to permit a human operator to interrupt the controller and cease automated tubular handling without dropping the tubular.

6. The system of claim 1, wherein the user interface comprises a display unit.

7. The system of claim 1, wherein the controller is adapted to stop the make-up or break-out process when the minimum time value is exceeded and at least one of the rotation and torque values at least substantially match the corresponding predetermined values.

8. The system of claim 1, further comprising a counterbalance operatively associated with the rotary drive to provide feedback on at least one of the position of, or weight applied by, a tubular or a tubular string, or both.

9. The system of claim 1, wherein one or more of the acceptable predetermined rotation, torque, and minimum time elapsed values depend on one or more parameters associated with the tubulars being handled.

10. The system of claim 9, wherein the parameters are adjusted based on a plurality of factors comprising the grade of pipe, type of tubular, nominal outer diameter size, weight per foot, number of threads, number of threads per inch, collar thread type, or a combination thereof.

11. An automated method of making-up or breaking-out tubulars with or from a tubular string, which comprises:

selecting a first tubular and a second tubular to make-up or break-out from each other, wherein the second tubular forms a part of the tubular string;

inputting information about the tubulars to a controller;

initiating rotation to make-up or break-out the first tubular with or from the second tubular;

monitoring one or more sensors during the make-up or break-out to obtain measured data regarding rotational turns, torque, and minimum time elapsed from initiating rotation;

comparing the measured data to acceptable predetermined values of rotational turns, torque, and minimum time elapsed;

stopping rotation based on the comparison of the minimum time elapsed from initiating rotation, and either rotational turns or torque, wherein at least two of the measured data meet or exceed at least two of the corresponding acceptable rotational turn, torque, and minimum time elapsed values; and measuring the change in torque between the first and second tubulars, change in tension value of at least one counterbalance cylinder associated with a tubular or the tubular string, or a combination thereof, wherein each counterbalance cylinder has feedback that comprises at least one of a position of a tubular relative to an initial position, relative to the tubular string, relative to a rotary drive, or a combination thereof; minimum time of rotation; and force settings of weight applied on the tubular or the tubular string, or both.

12. The method of claim 11, wherein the inputted information about the tubulars is adjusted based on a plurality of factors comprising the grade of pipe, type of tubular, nominal outer diameter size, weight per foot, number of threads, number of threads per inch, collar thread type, or a combination thereof.

13. The method of claim 11, which further comprises initiating remedial action if one of the values for turns, torque, or minimum time elapsed is unacceptable.

14. The method of claim 13, wherein the remedial action comprises automatic reinitiation of make-up or break-out, or a combination thereof.

15. The method of claim 13, wherein the remedial action comprises providing a warning signal to an operator.

16. The method of claim 15, wherein the operator manually stops or reinitiates the rotation, or both.

17. The method of claim 11, wherein the torque is measured based on a rotary drive connected to a tubular being made-up or broken-out.

18. The method of claim 11, wherein the acceptable predetermined values of rotational turns, torque, and time comprise at least two of maximum, minimum, and optimum values.

19. The method of claim 11, wherein the communicating comprises wireless communication between the controller and a plurality of sensors operatively associated at the controller, a server, or both, for measuring rotation, torque, and minimum time elapsed.

20. The method of claim 11, which further comprises displaying the measurement data to an operator.

21. The method of claim 20, wherein the display shows the words PASS and a second indicia of success when the measurement data is sufficiently acceptable or FAIL and a second indicia of failure when the measurement data is unacceptable.

22. The method of claim 11, which further comprises comparing at least two of the measured data values to at least two of the acceptable predetermined values, wherein at least one of the values is minimum time elapsed.

23. The method of claim 11, wherein the controller, operator, or both initiate termination of the rotation.

24. The method of claim 23, wherein the controller slows rotation based on one or more of the compared values before stopping rotation.

25. An automated method of making up or breaking out tubulars with or from a tubular string with a rotary drive, which comprises:

selecting a first tubular and a second tubular to make-up or break-out;

inputting information about the tubulars into a controller, wherein the controller is programmed with predetermined acceptable values of turns, torque, and minimum time elapsed;

initiating rotation to make-up or break-out of the tubular with or from the tubular string;

monitoring rotational turns, torque, and minimum time elapsed during the make-up or break-out to obtain measured data;

communicating the measured data from sensors operatively associated with the rotary drive to the controller; and stopping rotation based on a comparison of the measured data being within the range for all three of the acceptable rotational turns, torque, and minimum time elapsed from initiating rotation values; and measuring the change in torque between the first and second tubulars, change in tension value of at least one counterbalance cylinder associated with a tubular or the tubular string, or a combination thereof, wherein each counterbalance cylinder has feedback that comprises at least one of a position of a tubular relative to an initial position, relative to the tubular string relative to a rotary drive, or a combination thereof; minimum time of rotation; and force settings of weight applied on the tubular or the tubular string, or both.

26. The method of claim 25, which further comprises initiating remedial action if one of the values for turns, torque, or minimum time elapsed is unacceptable.

27. The method of claim 25, which further comprises displaying the measured data to an operator.

* * * * *